United States Patent [19]

Bassi et al.

[11] Patent Number: 4,469,071

[45] Date of Patent: Sep. 4, 1984

[54] DEVICE FOR CONTROLLING THE FUEL-FEED TO AN INTERNAL COMBUSTION ENGINE

[75] Inventors: Aldo Bassi; Franco Arcari, both of Milan, Italy

[73] Assignee: Alfa Romeo Auto S.p.A., Naples, Italy

[21] Appl. No.: 364,315

[22] Filed: Apr. 1, 1982

[30] Foreign Application Priority Data

Apr. 6, 1981 [IT] Italy ..... 20949 A/81

[51] Int. Cl.[3] ..... F02D 17/00

[52] U.S. Cl. ..... 123/481; 123/198 F

[58] Field of Search ..... 123/198 F, 481

[56] References Cited

U.S. PATENT DOCUMENTS 2,771,867 11/1956 Peras ..... 123/481
4,040,395 8/1977 Demetrescu ..... 123/481
4,146,006 3/1979 Garabedian ..... 123/481
4,172,434 10/1979 Coles ..... 123/481
4,398,520 8/1983 Schulz ..... 123/481

*Primary Examiner*—Ronald B. Cox
*Attorney, Agent, or Firm*—Charles E. Brown

[57] ABSTRACT

A control device for the fuel feed actuators of an internal combustion engine comprises a detector for detecting a first engine parameter (e.g. engine RPM), another detector for detecting another engine parameter (e.g. throttle angle), a further detector for detecting the operative condition of the engine (e.g. the temperature of the coolant), a pulse generator connected to the engine shaft, another pulse generator connected to an auxiliary shaft, a processor (CPU), a read only memory unit (ROM), a random access memory unit (RAM), two timers, the processor unit (CPU) performing a sequence of programmed steps in order to select which of the electric fuel injectors must be actuated, at what instant of time, for what time period and with what quantity of fuel each time.

1 Claim, 1 Drawing Figure

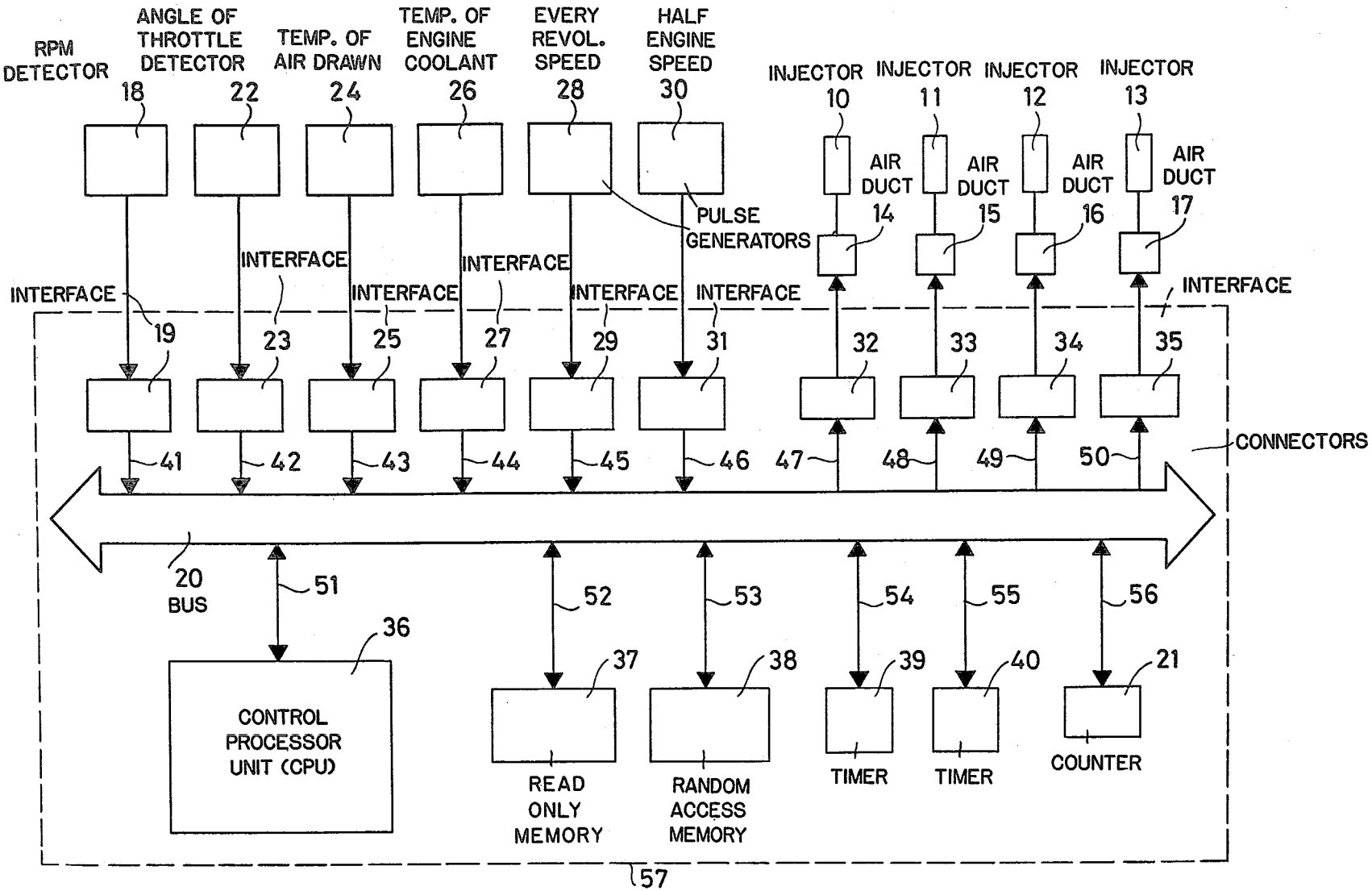
RPM DETECTOR
ANGLE OF THROTTLE DETECTOR
TEMP. OF AIR DRAWN
TEMP. OF ENGINE COOLANT
EVERY REVOL. SPEED
HALF ENGINE SPEED
PULSE GENERATORS
INJECTOR
INJECTOR
INJECTOR
INJECTOR
AIR DUCT
AIR DUCT
AIR DUCT
AIR DUCT
INTERFACE
CONNECTORS
BUS
CONTROL PROCESSOR UNIT (CPU)
READ ONLY MEMORY
RANDOM ACCESS MEMORY
TIMER
TIMER
COUNTER

DEVICE FOR CONTROLLING THE FUEL-FEED TO AN INTERNAL COMBUSTION ENGINE

Generally, in the engines working according to the Otto cycle the adjustment of the delivered power is carried out by varying the useful work at every cycle by throttling the mixture feed to the engine cylinders: this operation is controlled by the driver via the accelerator pedal which is operatively connected to the throttle(s) so that the latter, by introducing a pressure drop in the mixture flow or in the flow of the air which feeds the cylinders, bring about a variation of the feeding pressure and thus the cylinder filling is influenced.

Therefore, in the low-power field, the combustion of the mixture becomes harder, due to the diminished density of the charge, and the pumping work expenditure at every cycle is increased, to introduce the charge into the cylinders, because of the low feeding pressures: under these conditions, the engine work with an efficiency which is reduced relative to the top efficiency, the efficiency being the lower, the lower is the useful work of the cycle and this fact involves an increase of the fuel consumption.

An object of the present invention is to provide a device which permits to adjust the power delivered by the engine by varying, the rpm being the same, the number of active cycles effected in the time unit, so as to minimize the feed throttling and to work within the entire operative range of the engine with an efficiency which is close to the maximum value.

This object is achieved by a device which permits to deactuate a few actuators of the fuel feed, in order to cut off the fuel to one or more cylinders of the engine during a preselected number of cycles, by alternating the actuators which, from time to time, remain inactive, the power delivered by the engine thus becoming equal to the algebraic sum of the useful power supplied by the cylinders which remain operative and of the power absorbed by the cylinders which, conversely, remain inoperative.

The cylinder cutoff diagram, including the alternating sequence of the excluded cylinders, is selected consistently with the performances which are expected under the various operative conditions of the engine, having special consideration for the required power, the fuel economy which can be obtained and the permissible degree of periodic irregularity.

In order that a control device may be provided, which possesses the versatility and the accuracy which are desirable in order to optimize the engine performances, resort has been had to the adoption of a microcomputer to be programmed to command the deactuation of the actuators aforementioned according to a pre-established operative plan, which also provides for the alternate sequencing of the operative actuators, said plan being stored together with the operative sequences which are required to bring it into effect.

The control device referred to above is particularly suitable for an engine having a phased electronic injection system in which the feed actuators, the number of which is the same as that of the cylinders of the engine, consist of electric injectors which are driven by an electric magnitude which is proportional to the duration of their fuel dispensing and which are activated and deactivated according to the combinations which correspond to the preselected engine operation modes.

Features and advantages of the invention will be best understood by examining the accompanying drawings which shows a block diagram of a preferred embodiment of the invention.

The control device shown in the drawing is operatively connected to an electronic injection system for a 4-cylinder, 4-stroke internal combustion engine (not shown).

The numerals 10, 11, 12, 13 indicate the electric injectors which deliver the fuel into the air-drawing ducts and at 14, 15, 16 and 17 there are indicated the power stages of said electric injectors.

At 18 there is indicated a detector of an engine parameter, in the case in point the engine RPM, the detector being, for example, of the kind disclosed in the U.S. patent application Ser. No. 062,481 filed on July 31, 1979.

The detector 18 is capable of delivering via an interface 19 an impulsive signal the period of which is inversely proportional to the engine RPM. At 41 there is indicated the connexion of the interface 19 to the parallel interconnection bus 20 and at 21 there is indicated a counter which is used for determining the RPM, which is connected to the interconnection line 20 by the connector 53.

At 22, there is shown another detector for detecting another engine parameter, in the case in point the angle of the throttle(s) used for throttling the air drawn by the engine. Detector 22 is connected by the interface 23 and the connector 42 to the parallel interconnection bus 20. Every operative condition of the engine is defined by a couple of values of the engine RPM and the throttle angle.

At 24, there is indicated a detector of the temperature of the air drawn by the engine, whereas 26 is a detector of the temperature of the engine coolant: such detectors are connected via the interfaces 25 and 27 and the connectors 43 and 44, to the parallel interconnection bus 20. At 28 there is indicated a pulse generator, which is operatively connected to the mainshaft, and is capable of delivering, at every revolution of the engine, an impulsive signal composed of pulses which are properly phased relative to each other and are in a number equal to the fuel injections to be effected at every revolution of the engine; in the case of a 4-cylinder, 4-stroke engine with phased injection, two pulses per revolution are required, which are separated by the period of time which runs between the intake stages of two cylinders which follow one another in the ignition sequence.

At 29, there is indicated the interface which connects the generator 28, via the connector 45, to the parallel interconnection bus 20.

The numeral 30 indicates a pulse generator which is operatively connected to a shaft which is rotated at a speed equal to one half of the engine speed of rotation, and is capable of delivering a properly phased pulse at every engine cycle. An interface, indicated at 31, and a connector 46, connect the generator 30 to the parallel interconnection bus 20.

The power stages 14, 15, 16, 17 of the electric injectors are connected to the parallel bus 20 via the electric adaptation interfaces 32, 33, 34, 35 and the connectors 47, 48, 49, 50.

At 36, there is indicated a central processor unit, (CPU) which is connected via the connector 51 to the interconnection line 20. At 37, there is indicated a read only memory (ROM) connected by the connector 52 to the bus 20. At 38, there is indicated a random access memory (RAM) connected via the connector 53 to the bus 20.

The reference numerals 39 and 40 connote two timers used for determining the duration of the fuel dispensing to the electric injectors, the timers being connected via connectors 54 and 55 to the bus 20. At 57, the microcomputer has generally been indicated.

In the ramdom access memory, 38, stored from time to time, the values of the magnitudes as obtained from the detectors and also those of the magnitudes fed to the electroinjectors, and the values of the intermediate magnitudes as generated during the calculation, which are necessary to perform the programmes, are likewise stored in storage 38.

In the read only memory 37 the different calculation programmes are contained, which are utilized by the processor unit 36, namely the main programme, its sub-programmes, the auxiliary programmes, and there are also stored an engine fuel supply plan with the fuel dosage information as a function of the engine parameters, such as engine RPM and angle of the throttle(s) governing the throttling, or intake, negative pressure, the carburetion correction plan with the information as to the correct dosage as a function of the temperature of the engine coolant and the temperature of the drawn-in air. The same storage 37 holds also the information relative to the reference values of the two engine parameters aforementioned which defines the preselected combinations of operative actuators and inoperative actuators.

A cell of the storage 38 is used as a counting register for keeping the account of the pulses delivered by the generator 28 and resetting the count in correspondence with the pulse coming from the generator 30.

The operation of the control device described hereinabove is as follows.

The processor unit acquires, at the outset, the magnitudes which define the operative condition of the engine, as such unit receives from the detector 22 the throttle angle data, from the detectors 24 and 26 it receives the temperature of the intake air and the temperature of the engine coolant, respectively.

It is preferred that the engine RPM are acquired asynchronously relative to the main programme, by utilizing the pulsed signal coming from the detector 18, consistently with the calculation scheme disclosed in the U.S. patent application Ser. No. 184,630 filed on Sep. 8, 1980.

As the main programme for the determination of the operative mode which is appropriate for the engine is started, the processor unit enters into the storage 38 the encoded information which defines the operative mode of the engine which is characterized by all the electric injectors 10, 11, 12, 13 which are in action, whereafter the processor by a sub-programme, calculates the quantity of fuel that each electric injector is to deliver at every engine cycle under the particular operative condition as defined by the values taken by the engine RPM, the angle of the throttle(s), the temperature of the engine coolant and the temperature of the intake air.

Such a sub-programme is preferably carried out according to the procedure of the main programme as disclosed in the U.S. patent application Ser. No. 184,630.

As it proceeds with the performance of its main programme, the processor unit defines the operative mode which is associated to the particular working condition of the engine and checks through the couple of values taken by the engine RPM and the angle of the throttle(s), if only a preselected number of electric injectors must enter action, for example, two of them.

If such an assumption is wrong, the processor unit resumes the calculation of the quantity of fuel that each electric injector is to deliver at every engine cycle.

If, conversely, the assumption was correct, the processor unit arranges for the activation of two of the four electric injectors, and, more particularly, of the electric injectors 10 and 13 which fill the cylinders No. 1 and No. 4 of the engine, and presets the performance of a selected number of engine cycles consistently with such a mode of operation.

Subsequently, the processor unit acquires anew the magnitudes which define the operative state of the engine and calculate once again the quantity of fuel that each electric injector is to deliver at every engine cycle according to the procedures of the sub-programme aforementioned.

The processor unit then checks, having reference to the couple of values taken by the engine RPM and the throttle angle(s), if all of the electric injectors 10, 11, 12 and 13 have to enter action.

Should such an assumption be correct, the processor unit resumes the performance of the main programme and goes back to enter into the storage, 38, the information which defines the mode of operation of all the operative electric injectors 10, 11, 12 and 13.

If, conversely, the above assumption is untrue, the processor unit checks if the aforementioned preselected number of engine cycles with the electric injectors 10 and 13 operative has been carried out.

If said preselected number of cycles has not been performed, the processor unit resumes the performance of the main programme and goes back to calculate once again the quantity of fuel that each electric injector must dispense at every engine cycle.

If, conversely, said number of cycles has actually taken place, the processor unit presets the energization of the two electric injectors, 11 and 12, alternately with the electric injectors 10 and 13 and also provides to correct, with an appropriate enlargement coefficient, the quantity of fuel that each electric injector 11 and 12 must deliver at least for the first of said preselected number of cycles: these are performed, now, with the electric injectors 11 and 12 in activity.

The processor unit, thereafter, resumes its performance of the main programme and goes back to preset the performance of a preselected number of engine cycles with the mode of operation which is characterized by the two electric injectors 11 and 12 in activity.

The injection timing, that is the instant of time at which every electric injector, phased in the intake cycle of the attendant cylinder, opens, is controlled by the processor unit 36 by performing auxiliary programmes which are carried out concurrently with the cutoff requests bound to the pulsed signals coming from the generators 28 and 30.

Thus, correspondingly to each pulse coming from the generator 28, the processor unit performs the following steps:

it stops the main programme, it identifies which electroinjector is to be set in action by checking the state of said counting register, the latter effecting the count of the pulses delivered by the generator 28 during an engine cycle and resets the count in correspondence with the pulse coming from the generator 30, it checks if the electric injector indicated by said counting register is ready to enter action, while concurrently checking if, in the performance of the main programme, the activation of the electric injector which has been indicated by the counting register has been preset for being energized, (n) if said further condition has not been fulfilled, the processor unit:

commands the electric injector indicated by the counting register aforesaid to stay idle, steps forward by a unit said counting register, resumes its main programme, (m) if said further condition is satisfied, the processor unit:

commands the electroinjector indicated by said counting register to open by energizing the control line of the relevant power stage, presets a timer (39 or 40) so that the latter counts the duration, of the injection calculated by means of the specially provided sub-programme aforementioned, commands to so preset timer to start counting, resumes the performance of the main programme.

As the preselected timer completes its count, the processor unit carries out the following operations:

it steps the performance of the main programme, it checks if the duration of the injection has meanwhile been changed and, more particularly, if such a duration has been extended, if the duration of the injection has been extended, the timer is reloaded with the difference and is restarted.

if the duration of the injection has not been extended, the electric injector 10 is commanded to shut by de-energizing the control line of its power stage 14, steps forward by one unit said counting register, resumes the performance of the main programme.

As the timer completes the counter after having been restarted, the processor unit carries out the following steps:

it holds its main programme in abeyance, it commands the closure of the electric injector by de-energizing the control line of the power stage of said injector, steps forward by one unit said counting register, and resumes its main programme once again.

We claim:

1. A control device for actuators of fuel feed to the cylinders of an internal combustion engine of the type including a crankshaft, a shaft coupled to said crankshaft for rotation at one half the rotational speed of said crankshaft, said control device comprising detectors of engine parameters, a first pulse generator operatively connected to the engine crankshaft and capable of delivering at every engine revolution impulsive signals in numbers equal to the fuel deliveries to be effected by the actuators during a single revolution of the engine, a second pulse generator operatively connected to said shaft being rotated at a speed equal to one half the crankshaft speed and capable of delivering a phased pulse at every engine cycle, a central processor unit (CPU), a random access memory unit (RAM), a read-only memory unit (ROM) containing calculation programmes of the processor unit, an engine fuel supplying plan with the fuel-metering information as a function of said engine parameters, the values of reference to the engine parameters defining engine operative modes of the preselected combinations of operative and inoperative actuators, a counter register intended to keep the count of the pulses delivered by said first generator and to reset the count in correspondence with the pulse coming from said second generator, said processor unit comprising:

means to store in a cell of said random access memory the encoded information corresponding to the operative mode with all the actuators in operation;

means to calculate the quantity of fuel each actuator must deliver at every engine cycle in the particular working condition defined by the values taken by said engine parameters, via the fuel metering information associated to said engine parameters in the read only memory;

means to convert the calculated quantity into a command magnitude equivalent to the amount of fuel calculated for said actuators;

means to define the operative mode associated to the particular operative condition of the engine by checking via said engine parameters if a preselected number of actuators only must be activated or all actuators must be activated;

means for setting the activation of a first preselected number of said actuators, if a preselected number of actuators only must be activated;

means to preset the performance of a preselected number of engine cycles;

means to update the calculation of the quantity of fuel that each actuator must dispense at every engine cycle under the particular operative condition as defined by the actual values taken by said engine parameters, with the same procedure as for the previous calculation;

means to check if said preselected number of engine cycles has been performed;

means to set the actuation of a second preselected number of actuators alternately with respect to said first mentioned preselected number of actuators for another preselected number of engine cycles, if the previous number of engine cycles has been performed;

means to calculate an increased quantity of fuel that each actuator must dispense at least with the first cycle of said another preselected number of engine cycles;

means for setting the actuation of all actuators if all actuators must be activated;

means to command the actuation of the actuator indicated by said counter register, in correspondence with every pulse coming from said first generator, if it is ascertained that its actuation has been set on the basis of the forecast operative mode;

means to command the deactivation of said actuator utilizing said command magnitude equivalent to the quantity of fuel that each actuator must dispense at every engine cycle;

means to command the actuator indicated by said counter register to remain inoperative if it is ascertained that its deactivation has been set on the basis of the forecast operative mode;

and means to step forward by a unit of said counter register.

* * * * *